United States Patent [19]

Johnson et al.

[11] 4,406,234

[45] Sep. 27, 1983

[54] POSITIONING APPARATUS

[75] Inventors: Herbert Johnson; Richard M. Elliott, both of Beverly, Mass.

[73] Assignee: USM Corporation, Farmington, Conn.

[21] Appl. No.: 266,143

[22] Filed: May 22, 1981

[51] Int. Cl.[3] ..... D05B 21/00

[52] U.S. Cl. ..... 112/121.12; 112/121.15; 112/262.3

[58] Field of Search ..... 112/121.12, 121.15, 112/121.11, 121.29, 2, 308, 309, 262.3, 262.1, 266.1

[56] References Cited

U.S. PATENT DOCUMENTS

| | | | |
|---|---|---|---|
| 1,731,834 | 10/1929 | Wheeler | 101/287 |
| 3,037,472 | 6/1962 | Lockwood | 112/121.12 X |
| 3,329,109 | 7/1967 | Portnoff et al. | 112/308 X |
| 3,450,076 | 6/1969 | Bender | 112/121.12 X |
| 3,927,628 | 12/1975 | Palmer | 112/121.12 |
| 4,312,282 | 1/1982 | Dorosz et al. | 112/121.12 |

*Primary Examiner*—H. Hampton Hunter

*Attorney, Agent, or Firm*—William F. White

[57] ABSTRACT

An X-Y positioning apparatus having a dual drive arrangement for the X-direction of motion. The dual drive arrangement includes a pair of pinion gears engaging gear racks extending rearwardly from a frame member. A carriage is mounted for movement along the frame member in a Y-direction. The pinion gears are joined together by a rigid coupling which can be disengaged so as to allow for the adjustment and alignment of the X and Y directions of motion.

21 Claims, 7 Drawing Figures

POSITIONING APPARATUS

FIELD OF THE INVENTION

This invention relates to apparatus for positioning an article relative to an operative tool. In particular, this invention relates to the positioning of an article relative to the sewing needle of an automatic sewing machine.

BACKGROUND OF THE INVENTION

The need to position an article rapidly and accurately with respect to an operative tool is a basic requirement in today's automated machinery. For a programmable computer-controlled sewing machine, the workpiece must be quickly and accurately positioned relative to a reciprocating sewing needle. The actual movement of the workpiece must be accomplished during that portion of the reciprocating needle cycle when the needle is disengaged from the workpiece. As the size of the workpiece (which may in and of itself consist of a number of separate pieces to be joined together) increases, the problem of achieving the desired accuracy within the finite period of time allowed for positioning by the reciprocating needle becomes more difficult. The ever increasing weight of workpieces may pose special problems for a positioning apparatus designed to accommodate less heavy articles. For example, the structure of the positioning apparatus may be too flexible to accommodate heavier workpieces so as to result in vibration and excessive overshoot during rapid positioning movements.

One approach to the aforementioned problem of accurately positioning a heavy workpiece is to merely scale up the structure present in existing positioning apparatus. This however results in very large and heavy types of structure which even further add to the weight to be moved by a motorized drive source. This furthermore may result in apparatus that cannot be easily manufactured or thereafter adjusted.

OBJECTS OF THE INVENTION

It is an object of this invention to provide a positioning apparatus which rapidly and accurately positions relatively large and heavy pieces of work relative to an operative tool.

It is still another object of the invention to provide a positioning apparatus which rapidly and accurately positions relatively large and heavy pieces of work that are to be sewn by an automatic sewing machine.

It is a further object of the invention to provide a lightweight positioning apparatus capable of positioning large and heavy pieces of work relative to a reciprocating sewing needle.

It is a still further object of this invention to provide positioning apparatus which can be easily adjusted and aligned.

SUMMARY OF THE INVENTION

The above and other objects are achieved according to the present invention by providing a frame that is suspended above a pair of rail guides which define an X-direction of movement of the frame. A carriage is mounted for movement on the frame in a Y-direction transverse to the X-direction of movement of the frame. The frame consists of a frame member extending laterally over the rail guides and having a pair of gear racks which extend rearwardly from the frame member. The gear racks are driven by a pair of rigidly coupled motors having pinion gears which engage the gear racks. In accordance with the invention, the rigid coupling between the motors can be disengaged so as to allow for adjustment and alignment of the Y-axis carriage with respect to the X-axis rail guides to insure an accurate right angle between the two axes. In an alternative to the preferred embodiment, only one motor is utilized to drive the pair of gear racks. This is accomplished by mounting a pinion gear at the far end of the aforementioned rigid coupling. The rigid coupling couples the thus mounted pinion gear with the pinion gear associated with the single motor. Adjustment of the Y-axis motion with respect to the X-axis is accomplished in the same manner as that disclosed for the dual motor X-drive.

DESCRIPTION OF THE PREFERRED EMBODIMENT

Figure 1:
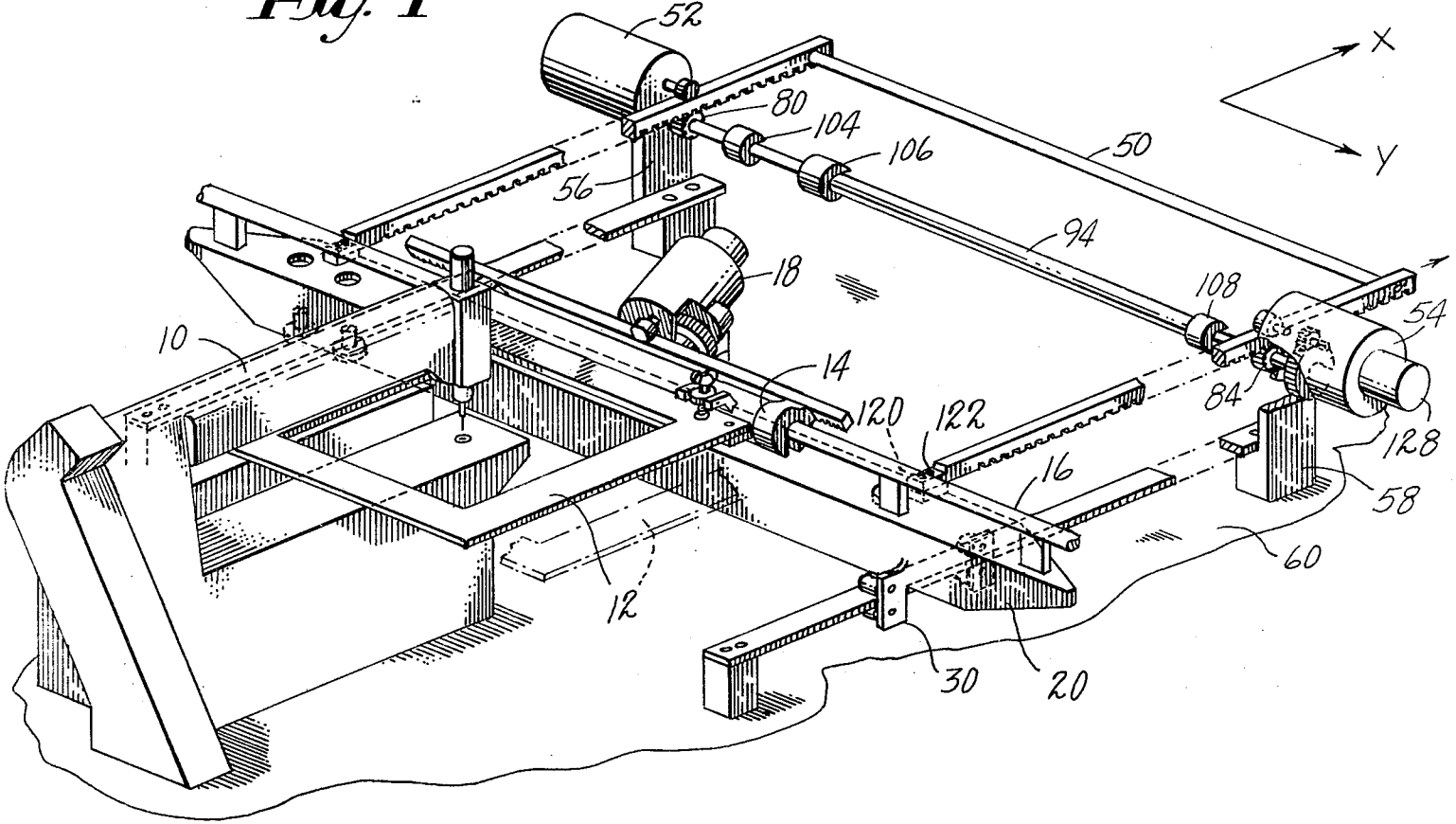
FIG. 1 illustrates the positioning apparatus relative to a sewing machine head.

Referring to FIG. 1, a sewing machine 10 is generally illustrated in conjunction with a pallet 12 which normally holds an article that is to be sequentially positioned underneath the needle of the sewing machine 10. The pallet 12 is removably mounted to a carriage 14 as shown. The carriage 14 is mounted for movement along the length of a cylindrical axis member 18. The cylindrical axis member 16 will be arbitrarily hereinafter referred to as the Y-axis of movement.

Figure 2:
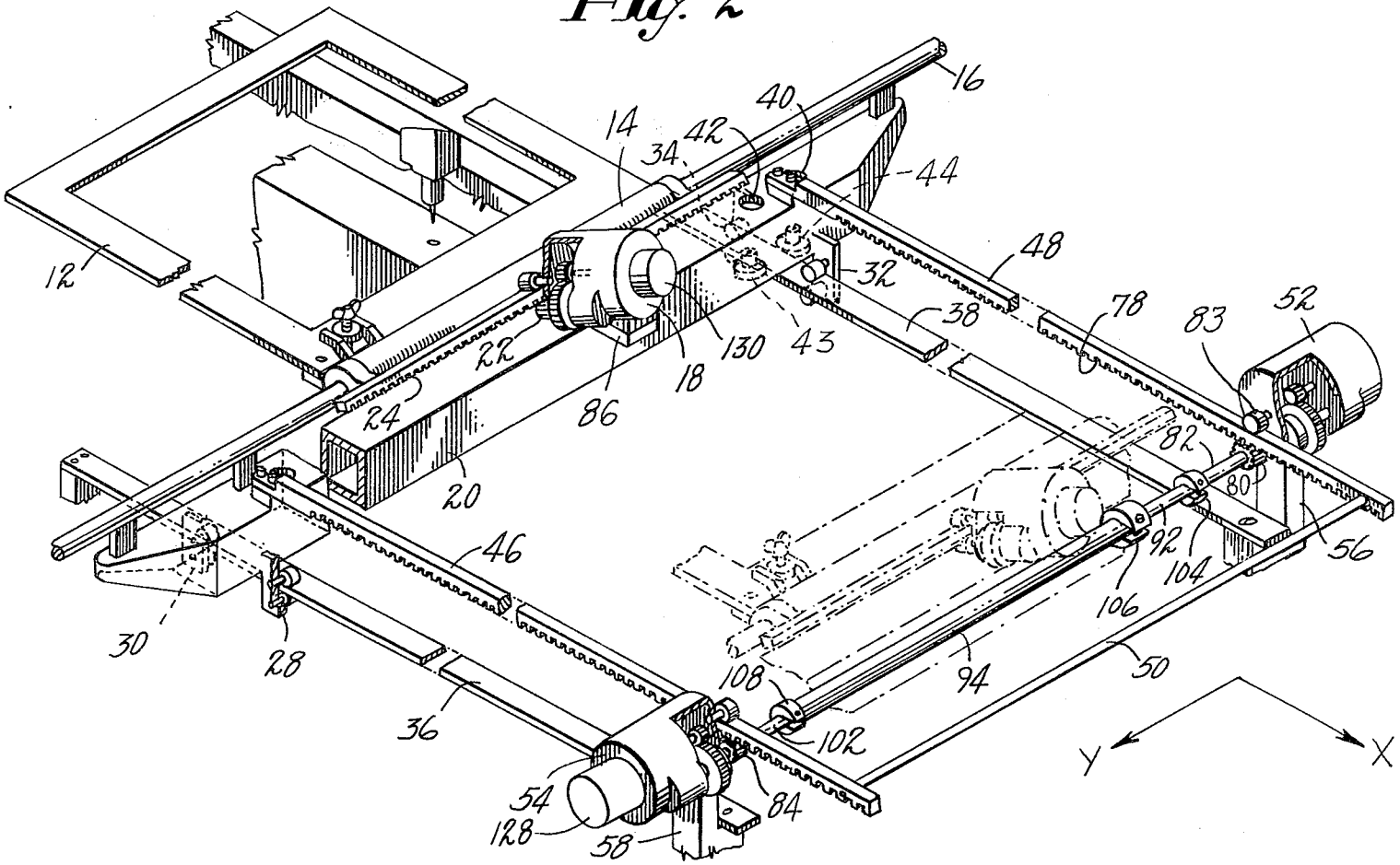
FIG. 2 is another view of the positioning apparatus.

Referring to FIG. 2, the motorized drive for the carriage 14 is seen to comprise a motor 18 mounted on a slant to a frame member 20. The motor 18 includes a pinion drive 22 that engages a gear rack 24 associated with the carriage 14. The gear rack 24 is slanted at the angle of mounting for the motor 18 so as to thereby accommodate the pinion drive of the slanted motor.

The frame member 20 is seen to include four sets of downwardly extending rollers 28, 30, 32 and 34. The downwardly extending rollers 28 and 30 engage the top and bottom surfaces of a rail guide 36. The downwardly extending rollers 32 and 34 engage the top and bottom surfaces of a rail guide 38. In this manner, the frame member 20 is stabilized at a vertical height above the rail guides 36 and 38 while at the same time being mounted for movement along these rail guides. The movement along the rail guides 36 and 38 will be hereinafter arbitrarily referred to as the X-axis of movement.

The frame member 20 also includes internally located roll guides 40 and 42. Each of these roll guides includes a roller such as 43 and 44 which engage the edges of the rail guide 38. It is to be noted that the engagement of the respective edges of rail guide 38 can be adjusted by vertical access holes going through the body of the frame member 20 to the roll guides 40 and 42. In this regard, the shaft for the respective roller 43 is eccentrically mounted within the roll guide 42. A rotational adjustment of the roll guide 42 through the access hole in the frame member 20 causes the shaft for the roller 43 to move inward or outward with respect to the rail guide 38. In this manner the position of the roller 43 with respect to the rail guide 38 can be adjustably established.

A pair of gear racks 46 and 48 extend backwardly from attachment points to the frame member 20. The ends of the gear racks 46 and 48 are connected by a bar 50. The gear racks 46 and 48 are driven by a pair of motors 52 and 54. The housings for the motors are attached to a pair of vertical supports 56 and 58 which extend from a common base 60 as shown in FIG. 1. It is to be noted in FIG. 1 that the common base 60 is common to all principle elements of the positioning apparatus as well as the sewing machine 10.

Figure 3:
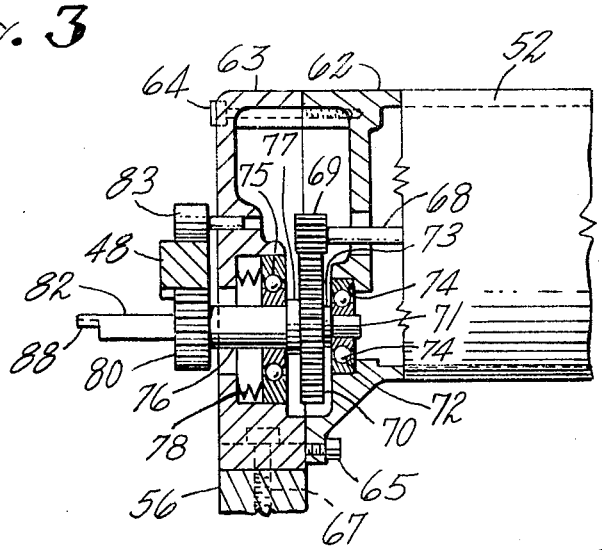
FIG. 3 illustrates the gear drive associated with one of the two dual motors.

Referring now to FIG. 3, the mounting of the motor 52 to the vertical support 56 is illustrated in detail. An outer casing 62 of the motor is seen to be attached to a front casing 63 for the motor via bolts such as 64 and 65. The front casing 63 is mounted to the vertical support 56 via a pair of bolts threadably received in the vertical support 56 as is illustrated by the dotted outline bolt 67. The motor 52 rotatably drives an output shaft 68 having a pinion 69 that engages a gear 70.

The gear 70 is affixed to a machined shaft 71 having various diameters so as to accommodate various elements press-fit thereon. An inner race of a ball bearing assembly 72 is press-fit onto the one end portion of the shaft 71. The inner race abuts a raised diameter portion of the shaft 71 which has the gear 70 press-fit thereon. The outer race of the ball bearing assembly 72 rests against defined shoulders 74 of the casing 62 so as to rotatably support the shaft 71 within the outer casing 62. The shaft 71 is otherwise supported by a ball bearing assembly 75 having an inner race press-fit onto a shaft portion 76. The inner race of the bearing assembly 75 abuts a raised diameter portion 77 of the shaft 71. The outer race of the bearing assembly 75 is preloaded towards the ball bearing assembly 72 by a spring 78 mounted within the front casing 63. It is hence to be appreciated that the shaft 71 rotates in response to a rotation of the output shaft 68 of the motor 52. A pinion gear 80 affixed to a portion 82 of the shaft 71 will also rotate in response to the rotation of the output shaft 68 of the motor 52. The pinion gear 80 engages the gear rack 48 as shown. The gear rack 48 is maintained in contact with the gear 80 by a roller 83. The rack 48 is caused to move in a linear fashion in response to a rotational movement of the gear 80.

It is to be appreciated that each of the motors 18, 52, and 54 include the same type of gear drive arrangement as is illustrated in FIG. 3. In this respect, each motor has a pinion gear such as the pinion gear 22 for the motor 18, the pinion gear 80 for the motor 52 and a pinion gear 84 for the motor 54 which engageably drives a respective rack. The casings for the motors 52 and 54 attach to the respective vertical supports 56 and 58. On the other hand, the casing for the motor 18 attaches to a mount 86 which establishes the angular slant of the motor 18.

Figure 4:
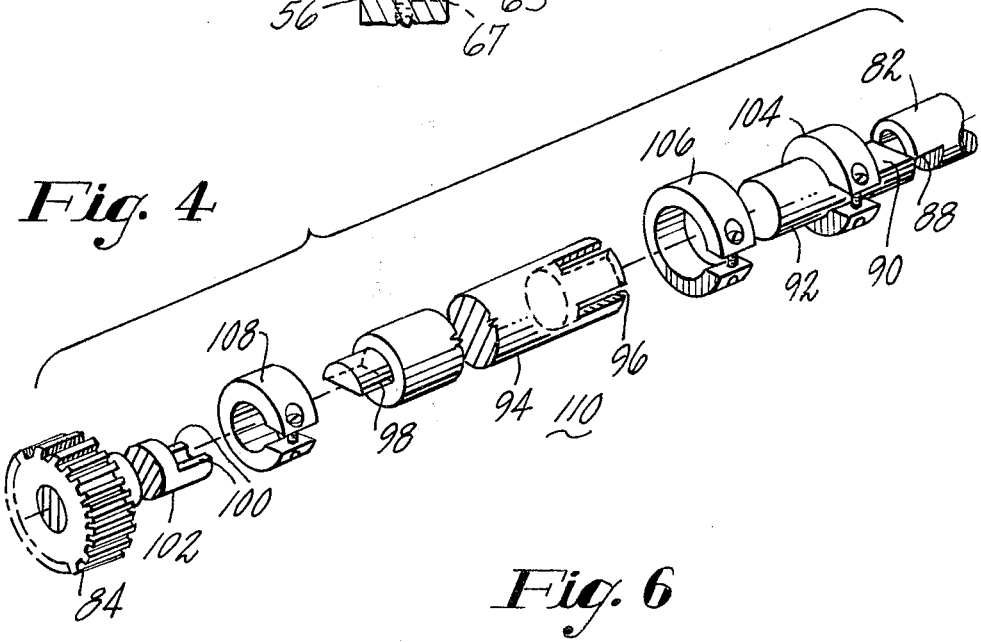
FIG. 4 is a detailed showing of the adjustable cross shaft coupling between the dual motor drive.

Referring again to FIG. 3, it is seen that the shaft portion 82 has a flat end portion 88 as shown. Referring to FIG. 4, the flat end portion 88 is seen to engage a corresponding flat end 90 of a shaft 92. The shaft 92 engages a shaft 94 having a slotted open end 96 which receives the circular end of the shaft 92. The opposite end of the shaft 94 comprises a flat end 98 which mates with a flat end 100 of a shaft 102 extending from the pinion gear 84 associated with the motor 54. It is to be noted that there are three separate connections for the shafts 82, 92, 94, and 102. In each instance, a split collar is used to secure the connection. In this regard, a split collar 104 secures the connection between the flat end 90 and the flat end 88 whereas a split collar 106 secures the coupling between the slotted end 96 and the circular end of the shaft 92 and a split collar 108 secures the flat ends 98 and 100 to each other. In this manner, a rigid shaft coupling 110 is achieved between to two drive motors 52 and 54.

Figure 5:
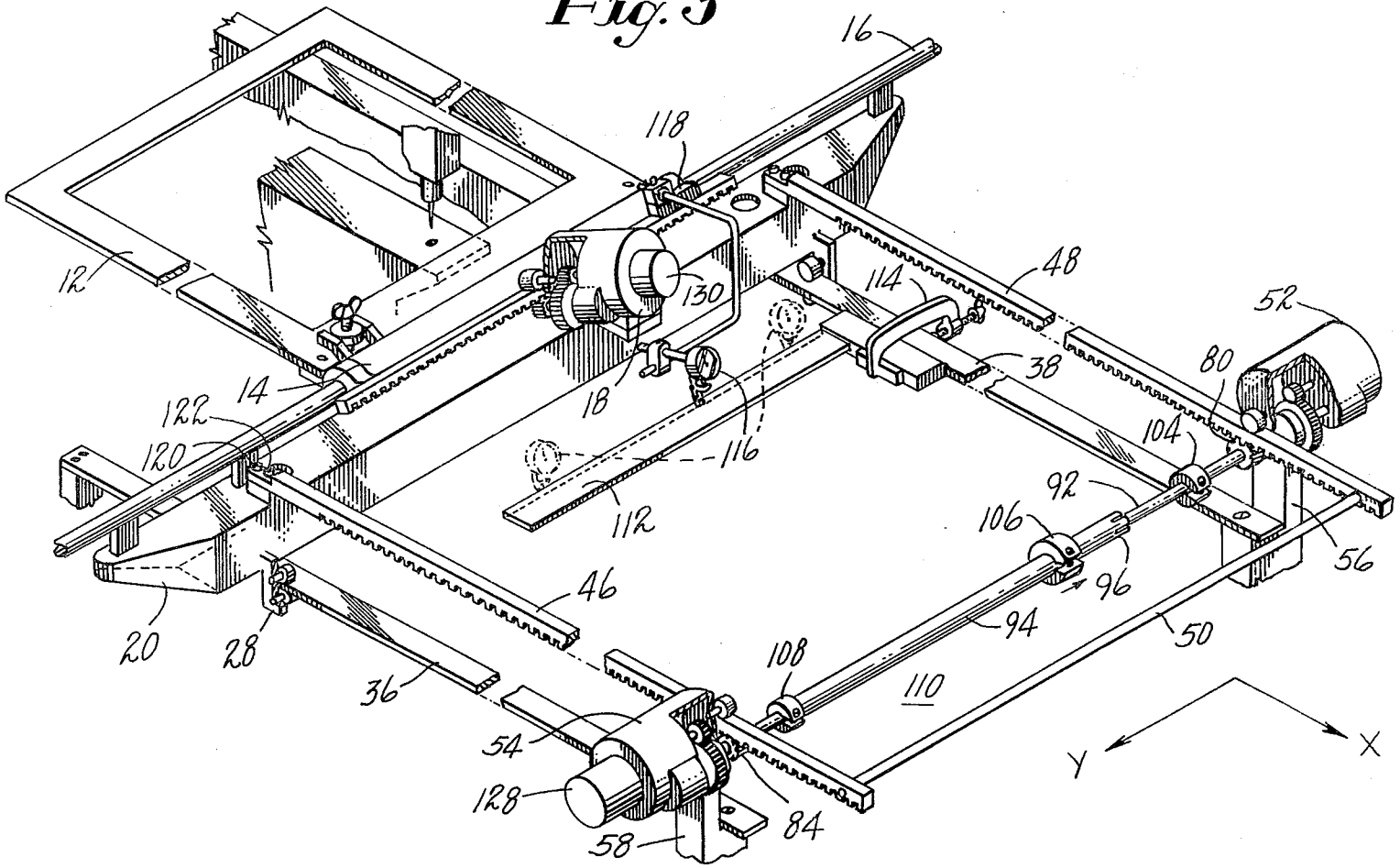
FIG. 5 illustrates the alignment procedure for the positioning apparatus.

As will now be explained, the particular configuration of the rigid shaft coupling 110 allows for an adjustment of the overall positioning apparatus and allows the two motor assemblies to be uncoupled for maintenance without losing the relative timing of the two pinion gears 80 and 84. This adjustment can be used to establish a two axis perpendicularity of the positioning apparatus. Referring to FIG. 5, the positioning apparatus is illustrated with a right angle square 112 clamped to the guide rail 38 by a C-clamp 114. An edge sensor 116 is attached via a bracket 118 to the carriage 14. The attachment of the bracket 118 to the carriage 14 can be a magnetic attachment so as to be easily removable.

The alignment and adjustment of the positioning apparatus with the edge sensor 116 and the clamped right angle square 112 proceeds in the following manner. The rigid shaft coupling 110 is partially assembled by positioning the mating flat ends 88 with 90 and 98 with 100. The split collars 104 and 108 are secured so as to thereby establish the length of the rigid shaft coupling. The split collar 106 is left loose so that shaft 92 can be rotated relative to shaft 94. The gear rack 48 is also fixed by a clamp or other means so as to not be movable in the X-direction. The pinion gear 84 associated with the drive motor 54 is now rotated so as to establish a perpendicularity of the Y-motion defined by the carriage 14 with respect to the X-motion as defined by the guide 38. This perpendicularity is checked by moving the carriage 14 along the cylindrical axis 16 so as to thereby cause the edge sensor 116 to track along the extended length of the right angle square 112. The requisite perpendicularity is finally established for the positioning apparatus when the pinion gear 84 has been appropriately rotated so as to cause the edge sensor 116 to move along the right angle square 112 without deviation in the X-direction. The split collar 106 is not tightened to prevent relative rotation of shafts 92 and 94. This rigidly couples the pinion gears 80 and 84 and hence the motors 52 and 54 to each other.

It is to be noted that the aforementioned adjustment of the positioning apparatus is facilitated through relatively loose connections of the racks 46 and 48 to the frame member 20. The adjustment is furthermore facilitated by a relatively loose threadable engagement of the bar 50 at the ends of the racks 46 and 48. When the requisite perpendicularity is achieved, the looseness in the connections of the racks 46 and 48 to the frame member 20 is removed as will now be explained.

Figure 6:
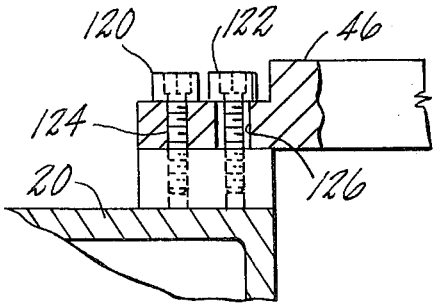
FIG. 6 illustrates a connection between certain elements present within the positioning apparatus.

The gear racks 46 and 48 are secured to the frame member 20 as shown by way of example for gear rack 46 in FIG. 6. Specifically, the end of gear rack 46 is seen to have a pair of bolts 120 and 122 which extend down through a pair of holes 124 and 126. The bolts 120 and 122 threadably engage the frame member 20. In accordance with the invention, the bolt 120 fits tightly within its hole 124 whereas the hole 126 is larger than the thread diameter of the bolt 122. This allows for the rack 46 to pivot about the bolt 120 during the aforementioned adjustment of the positioning apparatus. A similar two bolt connection allows for the same pivotal movement of the rack 48 with respect to the frame member 20. When the requisite perpendicularity is established, the bolts associated with each rack are all tightened down so as to prevent any further pivotal movement of the racks with respect to the frame member 20.

The control for the X-drive is monitored by a control system sensing the positional rotation of the motor 54. This is accomplished by an encoder 128 attached in a well known manner to the rear of the motor 54. The control of the Y-drive is similarly premised on sensing the rotation of the motor 20 through an encoder 130 attached in a well-known manner.

The positioning apparatus is now ready to execute motion in both the X and Y directions. It is to be noted that the maximum movement in the X-direction allows for the rear of the motor 20 to actually be positioned over the rigid shaft coupling 110 as shown by the dotted outline of the motor in FIG. 2. This positioning of the motor is facilitated by its slanted mounting which allows the rear of the motor to clear the rigid shaft coupling 110.

Figure 7:
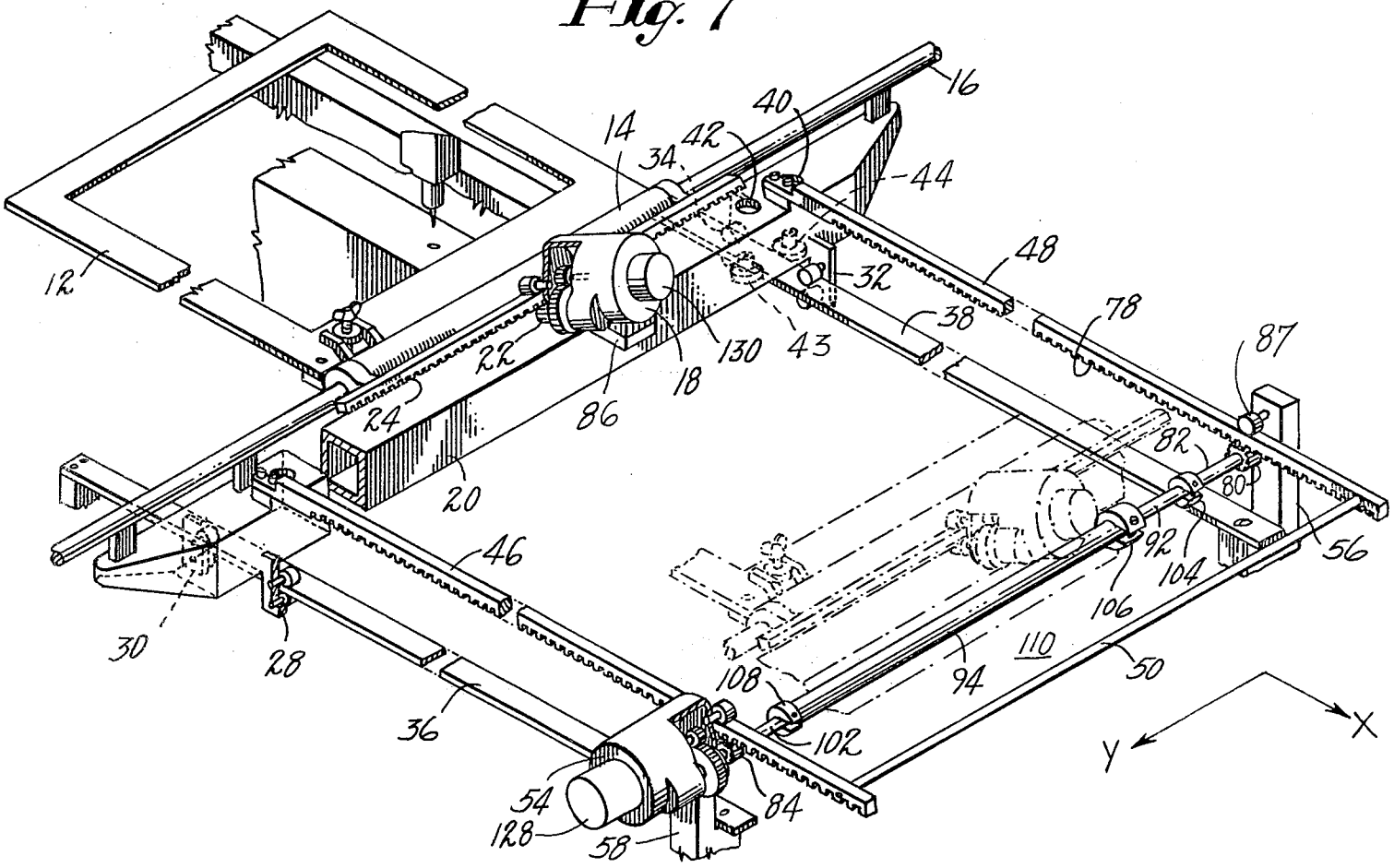
FIG. 7 illustrates an alternative positioning apparatus to that disclosed in FIGS. 1–6.

Referring now to FIG. 7, an alternative to the preferred embodiment of FIGS. 1–6 is illustrated. It is to be noted that like elements in FIG. 7 are similarly labeled relative to their respective counterparts in FIGS. 1–6. The X-direction of motion in FIG. 7 is seen to be governed by a single motor 54. This is in contrast to the dual motor drive arrangement consisting of motors 52 and 54 in FIGS. 1–6.

The single motor drive of FIG. 7 includes respective pinion gears 80 and 84 mounted to the rigid coupling 110. The pinion gear 80 is now driven by the motor 54 through the rigid coupling 110. The shaft 82 associated with the pinion gear 80 is rotatably mounted within the vertical support 56 in a manner well known in the art. The gear rack 48 is maintained in contact with the pinion gear 80 by the roller 83 which is mounted to the vertical support 56. The pinion gear 80 will drive the gear rack 48 in the X-direction in response to the rotational drive of the motor 54. The pinion gear 84 will in like manner drive the gear rack 46 so as to thereby produce a dual drive for the frame 20. It is to be appreciated that the aligning procedure of the Y-drive with respect to the X-drive as outlined and discussed in FIG. 6 is equally applicable to the apparatus of FIG. 7. In this regard, the disassembly of the rigid shaft coupling 110 between the pinion gears 80 and 84 is the same. The racks 46 and 48 are furthermore adjustable in precisely the same manner as heretofore discussed.

From the foregoing, it is to be appreciated that a preferred embodiment has been disclosed for a positioning apparatus. It is to be appreciated that alternative apparatus may be substituted for elements of the preferred embodiment without departing from the scope of the present invention.

We claim:

1. Apparatus for positioning a workpiece relative to a reciprocating sewing needle, said positioning apparatus comprising:

a frame mounted for movement at a predefined height above a pair of guides;

a pair of gear racks connected to said frame and extending in the direction of movement of said frame;

means, associated with each respective gear rack, for engageably driving said respective gear rack, so as to thereby provide a dual drive to the frame through said respective gear racks means for defining an axis of motion on said frame, said axis of motion being transverse to the direction of motion of said frame; and a carriage mounted for movement along said axis of motion, said carriage including means for carrying the workpiece to be positioned relative to said sewing needle.

2. The positioning apparatus of claim 1 further comprising:

means for rigidly coupling each of said means for engageably driving a respective gear rack so that each of said gear racks is driven the same amount.

3. The positioning apparatus of claim 2 wherein said means for engageably driving said respective gear racks comprises a pair of gears mounted to either end of said rigid coupling means.

4. The positioning apparatus of claim 3 wherein said means for engageably driving said respective gear racks comprises:

at least one motor connected to said rigid coupling means so as to drive said pair of gears mounted to either end of said rigid coupling means.

5. The positioning apparatus of claim 4 wherein said rigid coupling means comprises:

a pair of shafts extending outwardly from said pair of pinion gears, said shafts each having flat surfaces extending for a predetermined amount along the length of the shaft from one end thereof;

at least one middle shaft having flat surfaces extending for a predetermined amount along the length of the middle shaft from each end, said flat surfaces of the middle shaft mating with the flat surfaces of said pair of shafts extending from said pinion gears; and a pair of coupling devices which maintain the mating flat surfaces of said middle shaft in contact with the flat surfaces of said pair of shafts extending from said pinion gears.

6. The positioning apparatus of claim 5 wherein said middle shaft comprises:

a first and second shaft portion, said first shaft portion having an open end which can loosely receive an end of said second shaft portion so as to thereby allow said first shaft portion to rotate relative to said second shaft portion; and means for clamping the open end of said first shaft portion so as to thereby eliminate the relative rotation of said first shaft portion with respect to said second shaft portion.

7. The positioning apparatus of claim 1 further comprising:

means for adjusting the connections of said gear racks with respect to said frame so as to allow for an alignment of the axis of motion of said carriage with respect to the direction of motion of said frame.

8. The positioning apparatus of claim 2 wherein said means for engageably driving said respective gear racks comprises a pair of motors having respective pinion gears connected to said rigid coupling means, said pinion gears engaging said respective gear racks.

9. The positioning apparatus of claim 8 wherein said rigid coupling means comprises:

a pair of shafts extending outwardly from said pair of pinion gears, said shafts each having flat surfaces extending for a predetermined amount along the length of the shaft from one end thereof;

at least one middle shaft having flat surfaces extending for a predetermined amount along the length of the middle shaft from each end, said flat surfaces of the middle shaft mating with the flat surfaces of said pair of shafts extending from said pinion gears; and a pair of coupling devices which maintain the mating flat surfaces of said middle shaft in contact with the flat surfaces of said pair of shafts extending from said pinion gears.

10. The positioning apparatus of claim 9 wherein said middle shaft comprises:

a first and second portion, said first shaft portion having an open end which can loosely receive an end of said second shaft portion so as to thereby allow said first shaft portion to rotate relative to said second shaft portion; and means for clamping the open end of said first shaft portion so as to thereby eliminate the relative rotation of said first shaft portion with respect to said second shaft portion.

11. The positioning apparatus of claim 8 wherein said rigid coupling means comprises:

first means, extending from the first of said pair of motors for transmitting a rotational output of said first motor;

second means extending from the second of said pair of motors for transmitting a rotational output of said second motor; and means for adjustably coupling said first and second means together so as to rigidly join the rotational drive outputs of said pair of motors.

12. The positioning apparatus of claim 1 wherein said frame comprises:

a single beam extending transverse to the pair of guides, said beam having a plurality of rollers extending downwardly into contact with the top and bottom surfaces of the pair of guides, said beam furthermore having a pair of rollers which engage the edges of one of the pair of guides.

13. The positioning apparatus of claim 1 further comprising:

means for adjusting the connections of said gear racks with respect to said frame so as to allow for an alignment of the axis of motion of said carriage with respect to the direction of motion of said frame.

14. The positioning apparatus of claim 1 further comprising:

means for driving said carriage mounted for movement along said axis of motion independently of the dual drive to the frame.

15. A process of aligning a positioning apparatus for positioning a workpiece relative to a reciprocating needle having a frame mounted for movement relative to a pair of guides and a carriage mounted for movement on said frame, said frame being driven by a pair of gear racks having pinion gears associated therewith, the pinion gears having an adjustable coupling therebetween, said process comprising the steps of:

establishing a straight line reference perpendicular to at least one of said pair of guides;

affixing a sensing device to the carriage;

moving the carriage along the frame and sensing the deviation of the direction of movement of the carriage relative to the straight line reference; and independently rotating one of the pinion gears associated with one of the gear racks so as to move the associated gear rack in such a manner as to correct any sensed deviation.

16. The process of claim 15 further comprising the step of:

independently maintaining the remaining gear rack stationary while the other gear rack is being moved.

17. The process of claim 15 further comprising the step of:

establishing a rigid connection of said gear racks with respect to said frame after the carriage movement is aligned with respect to the straight reference line.

18. The process of claim 17 further comprising the step of:

establishing a rigid coupling between said pair of pinion gears so as to thereby eliminate the ability to independently rotate the pinion gears associated with the respective gear racks.

19. The process of claim 16 further comprising the step of:

establishing a rigid coupling between said pair of pinion gears so as to thereby eliminate the ability to independently rotate the pinion gears associated with the respective gear racks.

20. The process of claim 19 wherein said step of establishing a rigid coupling between said pair of pinion gears comprises the step of:

coupling an adjustable middle shaft to shafts extending from the pinion gears so as to permit relative rotation of said pinion gears during said step of independently rotating one of the pinion gears.

21. The process of claim 20 wherein said step of establishing a rigid coupling between said pair of pinion gears further comprises the step of:

rigidly coupling a pair of middle shaft portions together after the carriage movement is aligned with respect to the straight reference line.

* * * * *